US011577149B2

(12) United States Patent
Bollis

(10) Patent No.: US 11,577,149 B2
(45) Date of Patent: Feb. 14, 2023

(54) TRAINING ICE SKATE

(71) Applicant: Doubleup LLC, Minnetonka, MN (US)

(72) Inventor: Chris W. Bollis, Orono, MN (US)

(73) Assignee: DOUBLEUP LLC, Minnetonka, MN (US)

( * ) Notice: Subject to any disclaimer, the term of this patent is extended or adjusted under 35 U.S.C. 154(b) by 259 days.

(21) Appl. No.: 16/956,468

(22) PCT Filed: Dec. 21, 2018

(86) PCT No.: PCT/US2018/067288
§ 371 (c)(1),
(2) Date: Jun. 19, 2020

(87) PCT Pub. No.: WO2019/126747
PCT Pub. Date: Jun. 27, 2019

(65) Prior Publication Data

US 2020/0368602 A1 Nov. 26, 2020

Related U.S. Application Data

(60) Provisional application No. 62/609,052, filed on Dec. 21, 2017.

(51) Int. Cl.
*A63C 1/36* (2006.01)
*A63C 1/30* (2006.01)

(52) U.S. Cl.
CPC ..... *A63C 1/36* (2013.01); *A63C 1/303* (2013.01)

(58) Field of Classification Search
CPC .. A63C 1/34; A63C 1/36; A63C 1/303; A63C 3/04
See application file for complete search history.

(56) References Cited

U.S. PATENT DOCUMENTS 156,094 A 10/1874 Lemmon
756,560 A 4/1904 Austin
(Continued)

FOREIGN PATENT DOCUMENTS

CN 2469949 Y 1/2002
KR 20140057461 A 5/2014

OTHER PUBLICATIONS

American Athletic "PinkDoubleRunner." American Little Rocket Adjustable Double Runner: www.americanathleticshoe.com/products/american-little-rocket-adjustable-double-runner. Retrieved Aug. 3, 2020.

(Continued)

*Primary Examiner* — Brian L Swenson
(74) *Attorney, Agent, or Firm* — Grumbles Law PLLC; Brittany Haanan

(57) ABSTRACT

A training ice skate with support components that can offer built-in balance support and can teach proper form to a user who is learning to ice skate. More specifically, the training ice skate can include a boot mount having a base, a blade housing configured to house a blade, and a plurality of support mounts. The base can be configured to attach to a bottom of a boot, the blade housing can be centered on the base and configured to house a center blade, and the plurality of support mounts can be comprised of a plurality of side rail housings at non-center locations on the base that are configured to house a corresponding side rails.

20 Claims, 11 Drawing Sheets

(56) References Cited

U.S. PATENT DOCUMENTS

| | | | | | |
|---|---|---|---|---|---|
| 1,212,855 | A | | 1/1917 | Wachs | |
| 1,570,791 | A | | 1/1926 | Solarz | |
| 2,107,617 | A | | 2/1938 | Oetterer | |
| 2,598,218 | A | | 5/1952 | Brumby | |
| 2,764,417 | A | | 9/1956 | Sweet | |
| 2,917,315 | A | * | 12/1959 | Mihalik | A63C 1/36 280/11.12 |
| 2,920,897 | A | * | 1/1960 | Jensen | A63C 1/36 280/11.12 |
| 3,120,397 | A | | 2/1964 | Lepkofker | |
| 3,181,879 | A | | 5/1965 | Hodges | |
| 3,415,528 | A | | 12/1968 | Herold | |
| 3,497,211 | A | | 2/1970 | Nagin | |
| 3,934,892 | A | | 1/1976 | Baikie | |
| 3,951,407 | A | | 4/1976 | Calacurcio | |
| 3,965,585 | A | | 6/1976 | Stewart | |
| 3,999,409 | A | | 12/1976 | Bell | |
| 4,008,901 | A | | 2/1977 | Conn | |
| 4,021,054 | A | | 5/1977 | Csutor | |
| 4,073,075 | A | | 2/1978 | O'Brien | |
| 4,114,295 | A | | 9/1978 | Schaefer | |
| 4,198,771 | A | | 4/1980 | Foster | |
| 4,407,522 | A | | 10/1983 | Suroff | |
| 4,453,727 | A | | 6/1984 | Bourque | |
| 5,179,847 | A | | 1/1993 | Dorn | |
| 5,183,276 | A | | 2/1993 | Pratt | |
| 5,641,169 | A | | 6/1997 | Bekessy | |
| 6,203,028 | B1 | | 3/2001 | Kress | |
| 6,523,835 | B1 | | 2/2003 | Lyden | |
| 6,854,200 | B2 | | 2/2005 | Hipp et al. | |
| 7,641,203 | B1 | | 1/2010 | Carey et al. | |
| 7,766,346 | B2 | | 8/2010 | Spanier et al. | |
| 7,770,930 | B2 | | 8/2010 | McLeod | |
| 9,756,897 | B1 | * | 9/2017 | Millis | A63C 3/00 |
| 2003/0106243 | A1 | | 6/2003 | Tucker | |
| 2003/0192198 | A1 | | 10/2003 | Wright et al. | |
| 2007/0130804 | A1 | | 6/2007 | Levy et al. | |
| 2007/0283596 | A1 | | 12/2007 | Park | |
| 2009/0064541 | A1 | * | 3/2009 | Matthews | A63C 3/04 36/132 |
| 2010/0225100 | A1 | * | 9/2010 | DePetri | A63C 17/02 280/841 |
| 2014/0015208 | A1 | * | 1/2014 | Pokupec | A63C 1/36 280/7.1 |
| 2014/0097583 | A1 | | 4/2014 | Vaughn | |
| 2014/0110909 | A1 | * | 4/2014 | Pokupec | A43B 5/1641 280/11.12 |
| 2014/0319790 | A1 | | 10/2014 | Mayer | |

OTHER PUBLICATIONS

Rollergard "DoubleRunner." Rollergard Double Runner, Black: www.amazon.com/Rollergard-R-10072-Black-Double-Runner-Black/dp/B00OW1C56U/. Retrieved Aug. 3, 2020.

Gravelbike "Off The Beaten Path." Twin-Blade. https://janheine.wordpress.com/page/21/?iframe=true&preview=true%2F%3Fcat%3D. Retrieved Aug. 3, 2020.

Jarvis Jill "The Ice at Discovery Green" DoubleBlade. https://www jillbjarvis.com/the-ice-at-discovery-green-presented-by-the-houston-chronical-november-17-2012-january-27-2013/. Retrieved Aug. 3, 2020.

* cited by examiner

TRAINING ICE SKATE

FIELD OF THE DISCLOSURE

This disclosure relates to ice skates, and more particularly, to ice skates having components that add balance and support to a wearer in the upright position.

BACKGROUND OF THE INVENTION

Ice skates provide individuals with the ability to smoothly travel across ice and to participate in ice-related sports such as competitive ice-skating, hockey, and speed skating. However, ice is inherently slippery and learning how to use ice skates on ice can be difficult. Traditional methods of aiding individuals while they are learning to use ice skates involve the use of tall, handheld devices that the user grasps in front of them. These are disadvantageous as they do not offer a realistic skating experience to the user and, when a user improves, the user cannot leave the handheld device behind and pick it up again when needed without needing to travel back to where the device was left. Other previously known embodiments are ice skates having multiple blades. These multiple bladed ice skates are disadvantageous because they also provide constant support and do not adjust according to the user's skill level. Further, no previously designed training device for teaching a person to ice skate provides the ability to help a new skater learn to skate while maintaining proper form. It is desirable to provide a modified ice skate that offers support and additional balance to a user only when it is needed, that prevents the formation of bad habits in terms of skating form, and that may be adjustable based on a user's increasing skill level.

SUMMARY OF THE INVENTION

This disclosure relates to an ice skate, and more particularly, to an ice skate with support components that can offer built-in balance support to a user. In an illustrative but non-limiting example, the disclosure provides a training ice skate boot mount. The boot mount can have a base, a blade housing centered on the base configured to house a metal center blade, and a plurality of side rail housings at non-center locations on the base configured to house a plurality of side rails.

In some examples, the side rails of the training ice skate can be removable, can have a shorter profile than the center blade, can attach to the plurality of side rail housings using a friction fit, can removably attach to the side rail housings using countersunk screws, bolts, and combinations thereof, can be beveled at a non-parallel angle to the base, and can be made of an elastomeric compound or other flexible material.

In some examples, the plurality of side rails can be configured to attach to the side rail housings by sliding into the plurality of side rail housings along a connection point, the connection point between the plurality of side rails and the plurality of side rail housings can be a dovetail joint or a t-slot joint, and a rear end of each of the plurality of side rail housings can have a stop.

In some examples, the plurality of side rails can be comprised of at least two interchangeable sets of side rails, wherein each set of interchangeable side rails can have a different height than each other set, and the side rail housings can be configured to fit only one set of side rails at a time.

In some examples, the plurality of side rails can be comprised of a flat stopper on a boot-facing side of the side rail housing, a shaft, and a cap on a ground-facing side of the base. The flat stopper can have a larger diameter, width, or length than an aperture in the base and can prevent each side rail from separating from the base in a first direction. The cap can protrude out from a ground-facing side of the base and, similar to the flat stopper, can have a larger diameter, width, or length than the aperture and can prevent each side rail from separating from the base in a second direction. The shaft can pass through the aperture to connect the flat stopper to the cap.

In some examples, the plurality of side rails can be fixed in place using fastening means such as screws, bolts, rivets, adhesives, and combinations thereof, can have a shorter profile than the center blade, and can be made of an elastomer. In some examples, the base can be configured to attach to the bottom of the boot using rivets, bolts, screws, or an adhesive. In other examples, the base can be permanently affixed to the bottom of the boot (for example, using fastening means such as rivets, bolts, screws, adhesives, and combinations thereof), the base can be a continuation of the sides of the boot that extends downward from a top of the boot and wraps under the boot so that the base and the boot can be one piece, or the base, the blade housing, the plurality of side rail housings, and the plurality of side rails can be one continuous piece.

Similar to above, if the boot and the base are one piece, the plurality of side rails can be removable. Further, the plurality of side rails can removably attach to the plurality of side rail housings using a friction fit, the plurality of side rails can be configured to removably attach by sliding into the plurality of side rail housings along a connection point, the connection point between the plurality of side rails and the plurality of side rail housings can be a dovetail or t-slot joint, and a rear end of each of the plurality of side rail housings can have a stop.

In some examples, if the boot and the base are one piece, the plurality of side rails can be comprised of at least two interchangeable sets of side rails, each set of interchangeable side rails can have a different height than each other set, and the side rail housings can be configured to fit only one set of side rails at a time.

In another illustrative but non-limiting example, the disclosure provides a training ice skate boot mount, wherein the boot mount can have a base; a blade housing centered on the base and configured to house a metal center blade; and a pair of side rail housings at non-center locations on the base configured to house one or more sets of removable and interchangeable side rails.

In some examples, a first side rail housing can be located on a first side of the blade housing, a second side rail housing can be located on a second side of the blade housing, and a first set of removable and interchangeable side rails can have different heights than a second set of removable and interchangeable side rails.

In another illustrative but non-limiting example, the disclosure provides a method of adjusting support offered by a training ice skate, the method including the steps of sliding a first side rail having a first height out from a first side rail housing that is located on a first side of a center blade on a bottom of the training ice skate and sliding a second side rail having the first height out from a second side rail housing that is located on a second side of the center blade on the bottom of the training ice skate. In some examples, each side rail can attach to its corresponding side rail housing using a friction fit, and a rear end of each of the side rail housings can have a stop.

In another illustrative but non-limiting example, the disclosure provides a training ice skate that can include a boot mount and a plurality of support mounts. The boot mount can have a base configured to attach to a bottom of a boot and a blade housing centered on the base that can be configured to house a metal center blade.

In some examples, the plurality of support mounts can be configured to mount to the base, can be rigid, and can be located at four corners of the base. More specifically, the support mounts can be quadrilateral pieces and can have a center aperture, or the support mounts can be posts.

In some examples, the plurality of support mounts can be configured to mount to a side of the metal center blade, can be rigid, and can be comprised of a width component that protrudes out in a perpendicular plane to the blade. For example, each of the plurality of support mounts can have an elongated blade mount that runs parallel to the metal center blade and attaches on a back end to a first end of the width component and a side rail that runs parallel to the metal center blade and attaches on a back end to a second end of the width component.

In another example, each of the width components can be a solid block having a flat, quadrilateral, bottom-facing surface and a sloped, upper-facing surface. The sloped, upper-facing surface can slope downward from in inner portion of the solid block to an outer portion of the solid block. In some cases, the plurality of support mounts can be configured to attach in a reversed position, so the flat, quadrilateral surface is an upper-facing surface and the sloped surface is a bottom-facing surface. Further, each of the plurality of support mounts can have of a side rail projecting downward and/or upward from the outer portion of the solid block.

In some examples, each of the plurality of support mounts can be foam blocks positioned on the side surfaces of the metal center blade. For example, the foam blocks can attach to each other through a gap in the metal center blade.

In some examples, the plurality of support mounts can have a base to support the boot mount; a front and a rear boot cage that together surround at least a portion of the boot, the boot mount, and a portion of the metal center blade; and a locking mechanism for attaching the front and the rear boot cages to each other. The base can be relatively flat and have an aperture through which the portion of the metal center blade can protrude. More specifically, the front boot cage can have a front adjustment control and at least one cutout, the rear boot cage can have a rear adjustment control and at least one cutout, and the locking mechanism can have two side straps that are each attached on their first ends to opposite sides of the front boot cage and an attachment point on second ends of each of the two side straps that enable the two side straps to attach to each other. In some cases, each of the two side straps wrap around to a back of the rear boot cage where they can attach to each other.

The above summary is not intended to describe each and every example or every implementation of the disclosure. The Description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
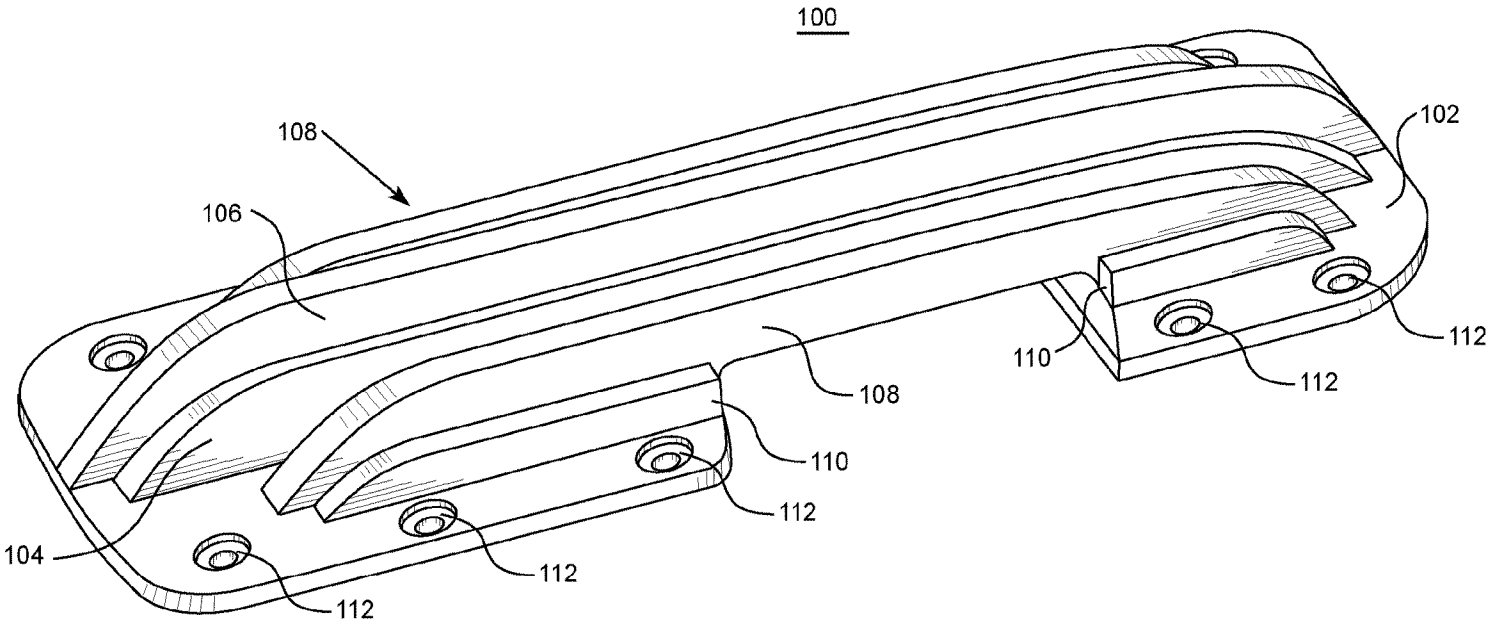
FIG. 1 is a perspective bottom view of a boot mount of a training ice skate of the present disclosure.

The present disclosure relates to training ice skates, and more particularly, to an ice skate with support components that can offer built-in balance support to a user. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements; those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Training ice skates of the present disclosure can be used, without limitation, for training, amusement, and strength-building purposes. An ice skate of the present disclosure can include a boot and a boot mount. The boot mount can have a base configured to attach to a bottom of the boot, a blade housing centered on the base configured to house a metal center blade, and a plurality of side rails or support mounts at non-center locations on the base configured to house a plurality of side rails.

Figure 2B:
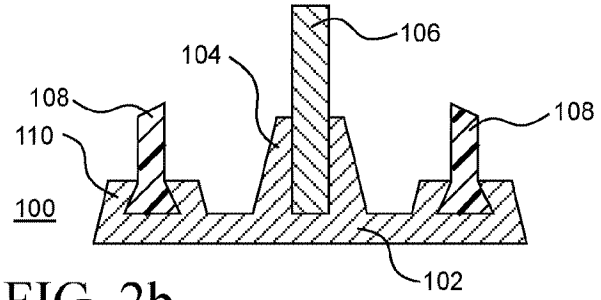
FIG. 2*b* is a front elevational, cross-sectional view of one embodiment of the boot mount of FIG. 1.
Figure 2A:
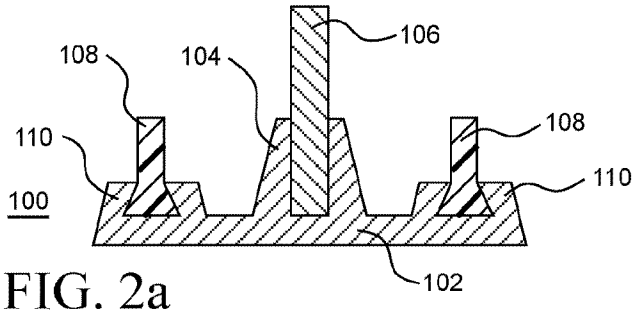
FIG. 2*a* is a front elevational, cross-sectional view of one embodiment of the boot mount of FIG. 1.
Figure 3A:
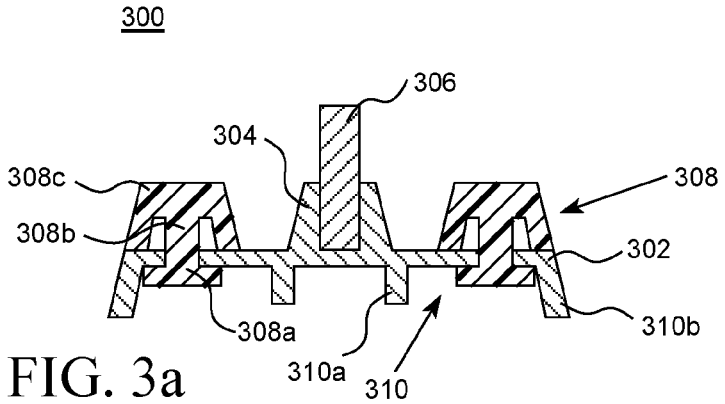
FIG. 3*a* is a front elevational, cross-sectional view of one embodiment of a boot mount of a training ice skate of the present disclosure.
Figure 3B:
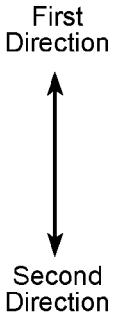
FIG. 3*b* is a front elevational, cross-sectional view of one embodiment of a boot mount of a training ice skate of the present disclosure.
Figure 3B:
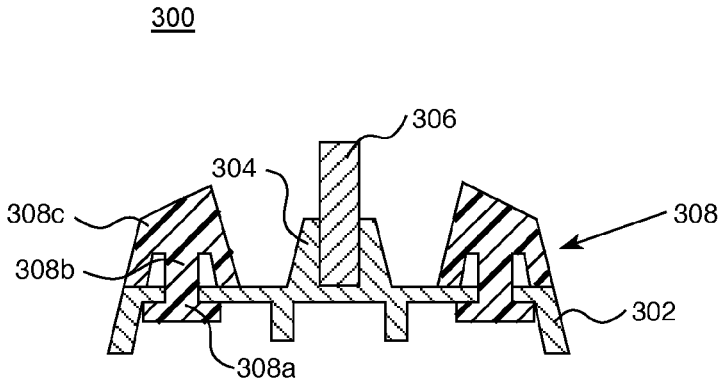
Figure 7:
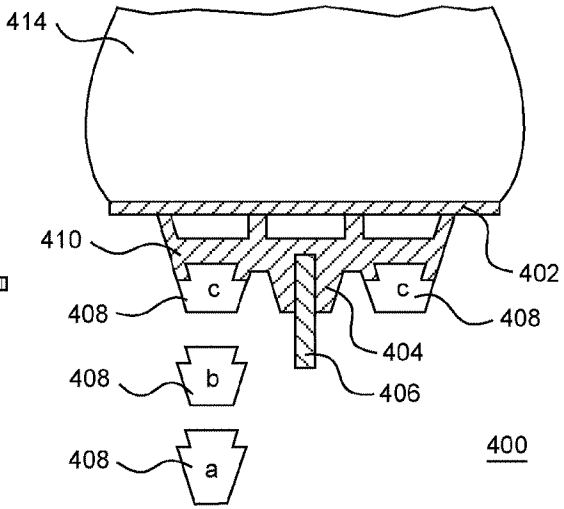
FIG. 7 is a front elevational view of one embodiment of the boot mount of FIG. 5*a*.
Figure 8:
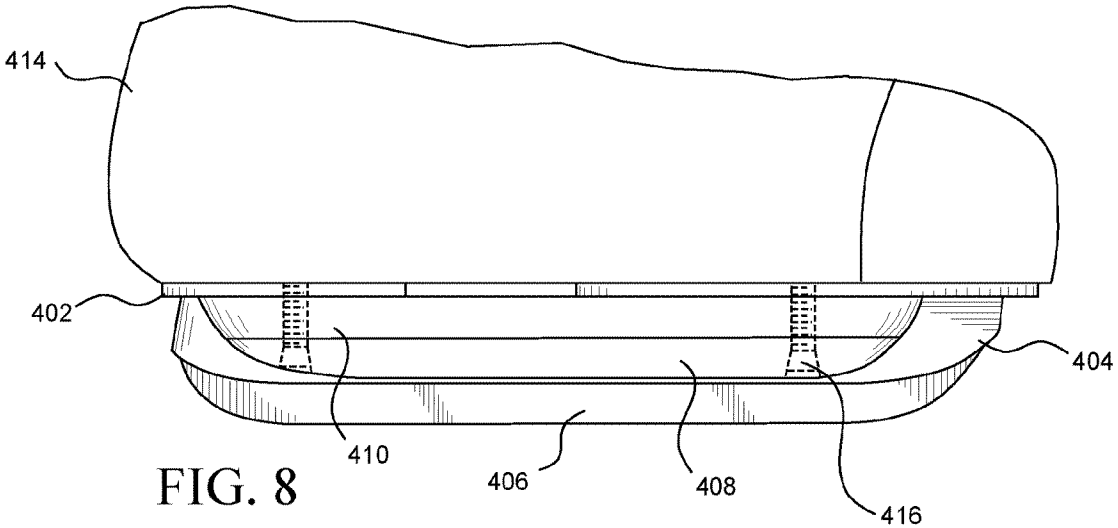
FIG. 8 illustrates a connection means for attaching a side rail to a side rail housing.
Figure 9:
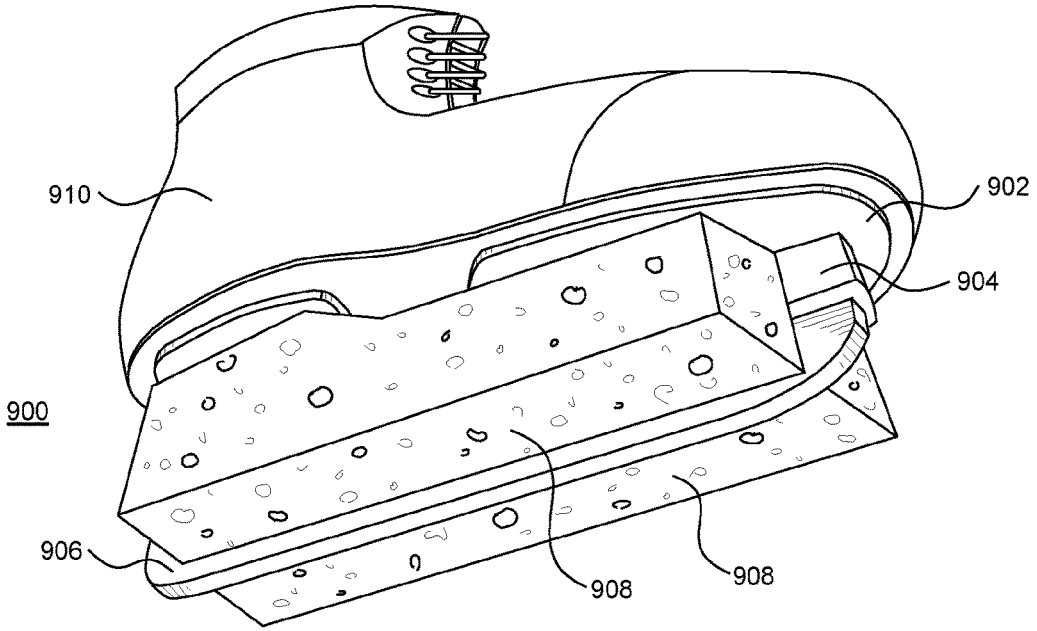
FIG. 9 is a perspective bottom view of a training ice skate of the present disclosure.
Figure 10:
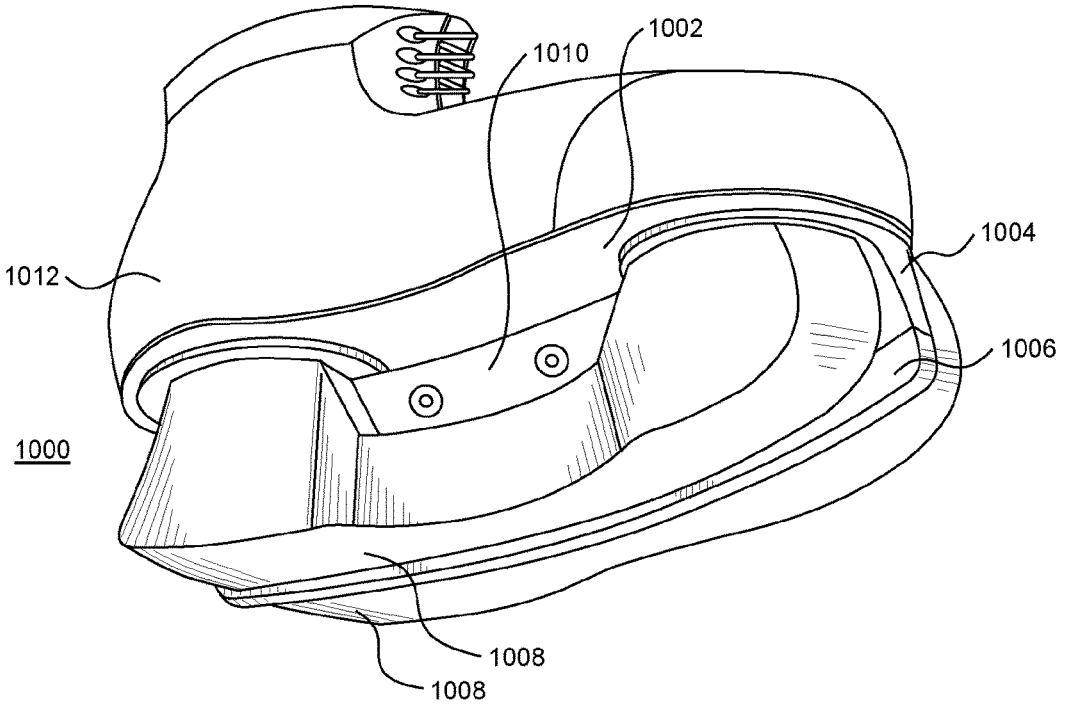
FIG. 10 is a perspective bottom view of a training ice skate of the present disclosure.
Figure 12:
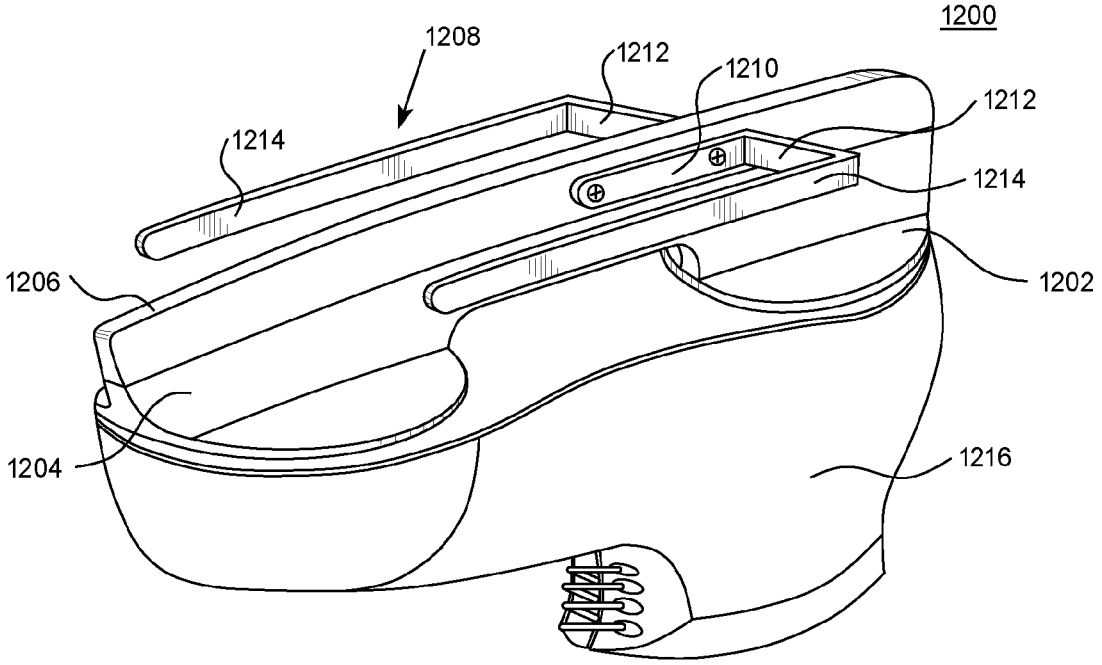
FIG. 12 is a perspective bottom view of a training ice skate of the present disclosure.
Figure 13:
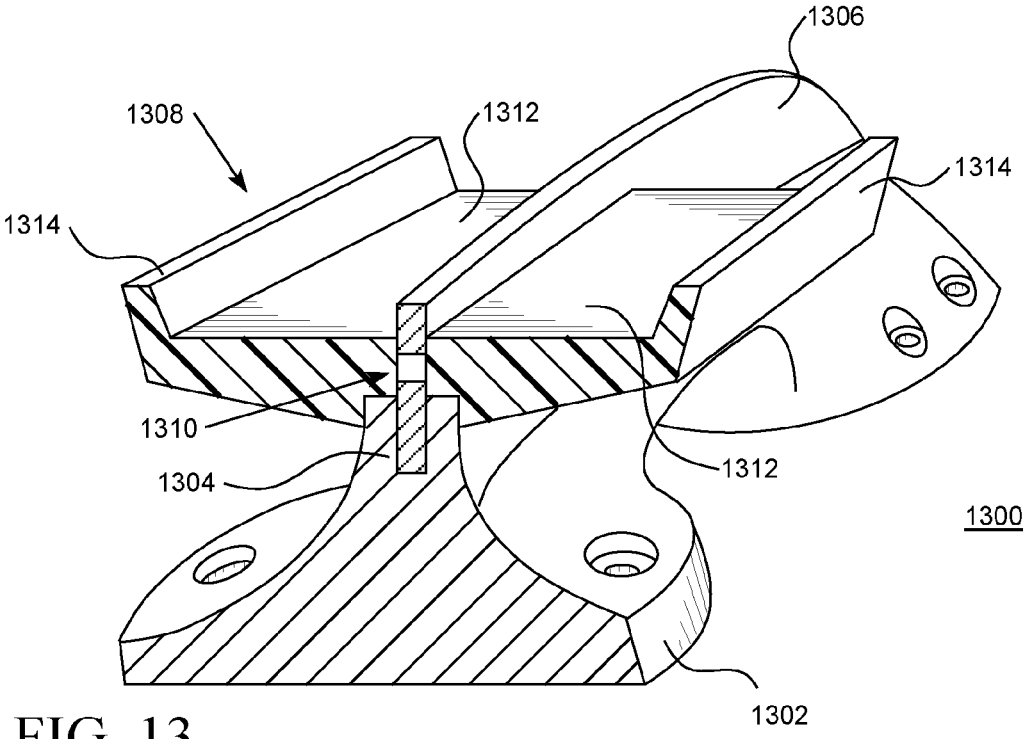
FIG. 13 is a perspective bottom view of a training ice skate of the present disclosure.
Figure 14:
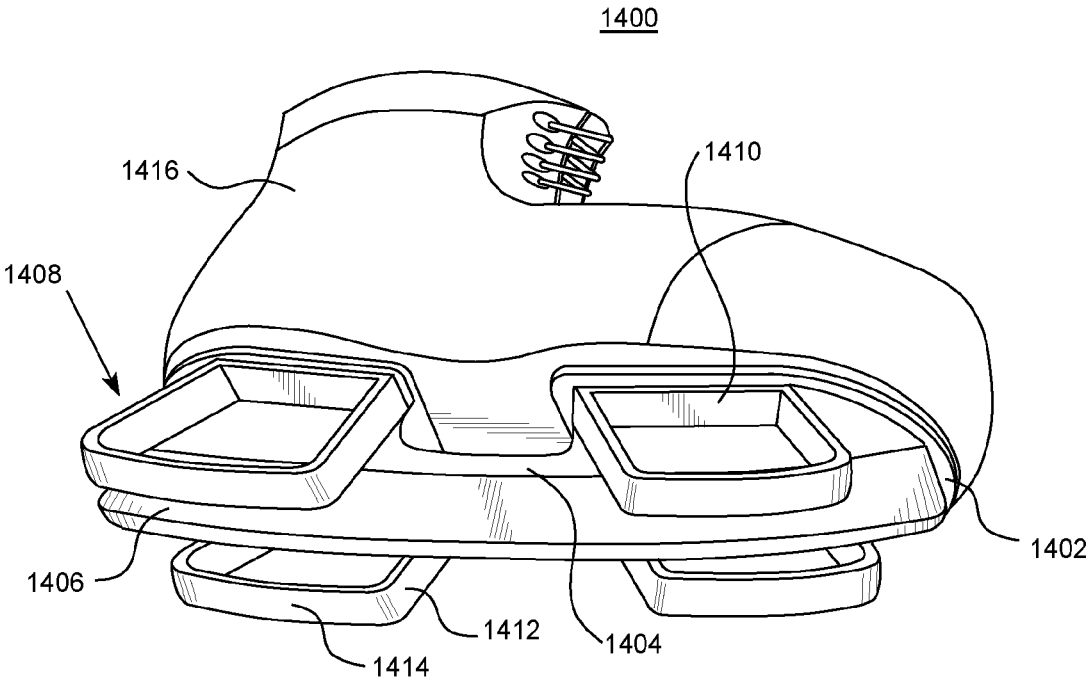
FIG. 14 is a perspective bottom view of a training ice skate of the present disclosure.
Figure 15:
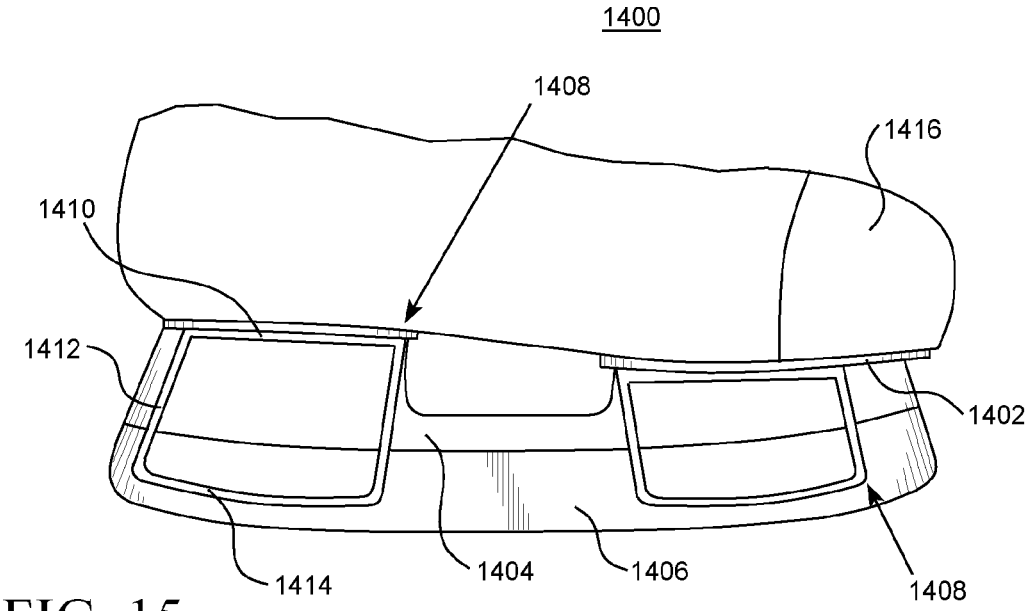
FIG. 15 is a right side elevational view of the training ice skate of FIG. 14.
Figure 16:
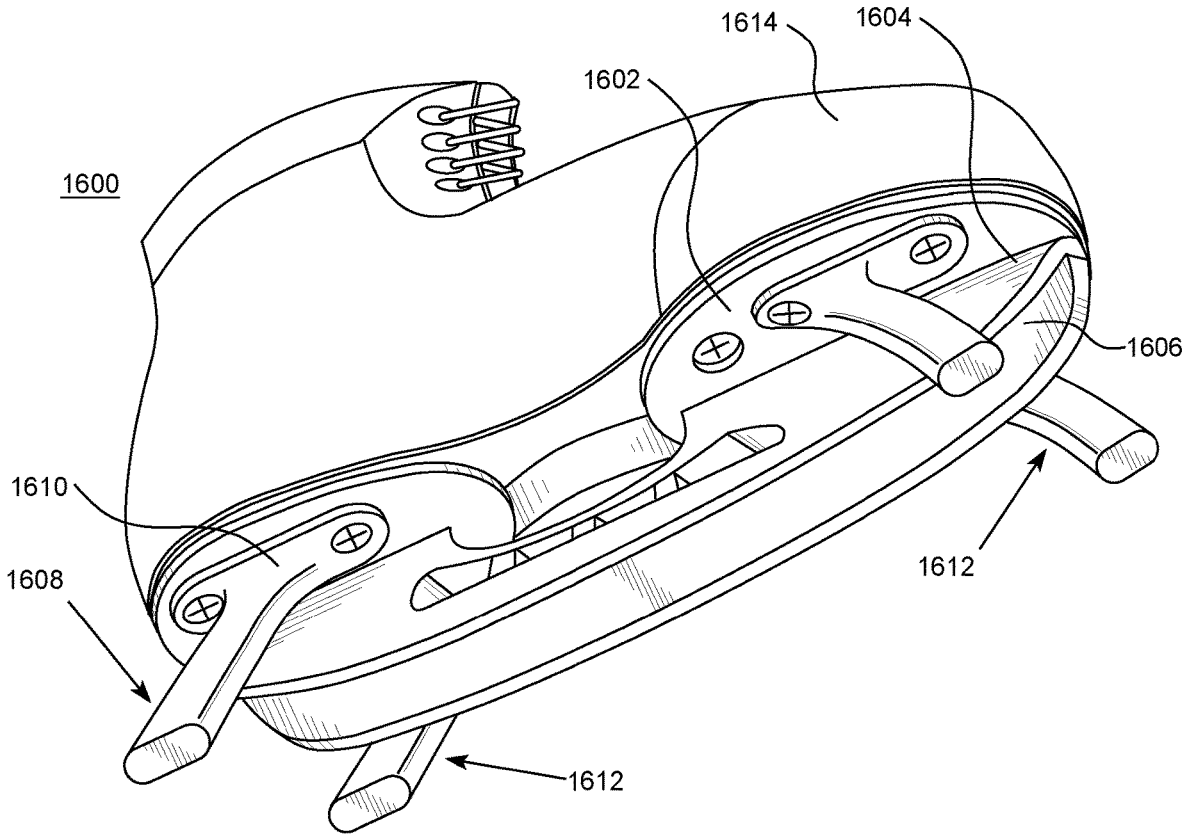
FIG. 16 is a perspective bottom view of a training ice skate of the present disclosure.
Figure 17:
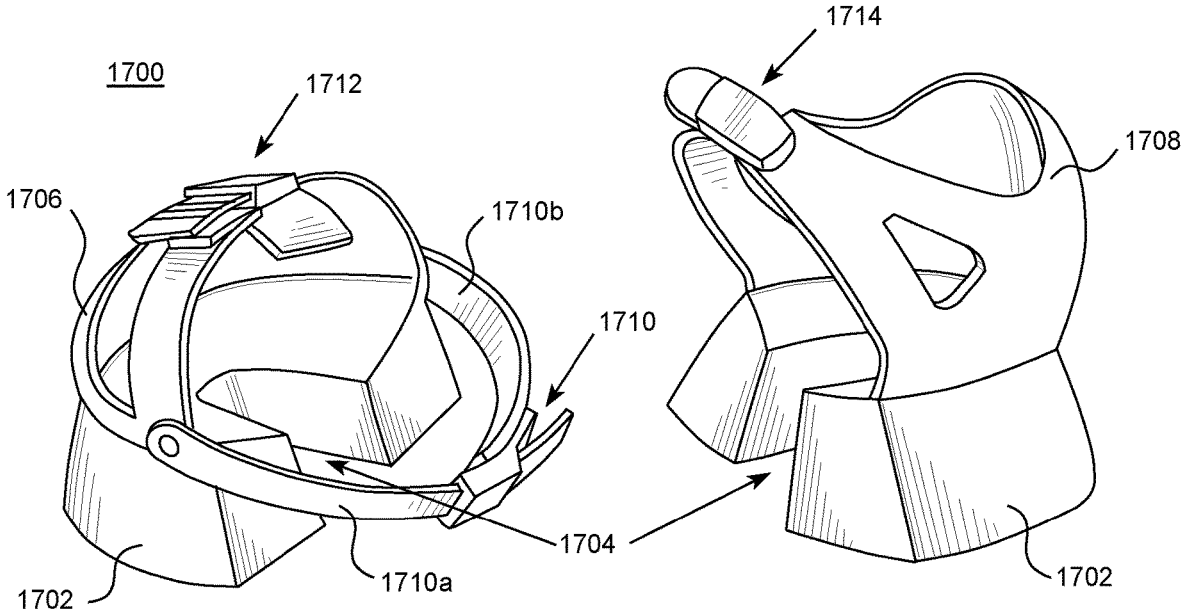
FIG. 17 is a perspective side view of a training ice skate of the present disclosure.
Figure 18:
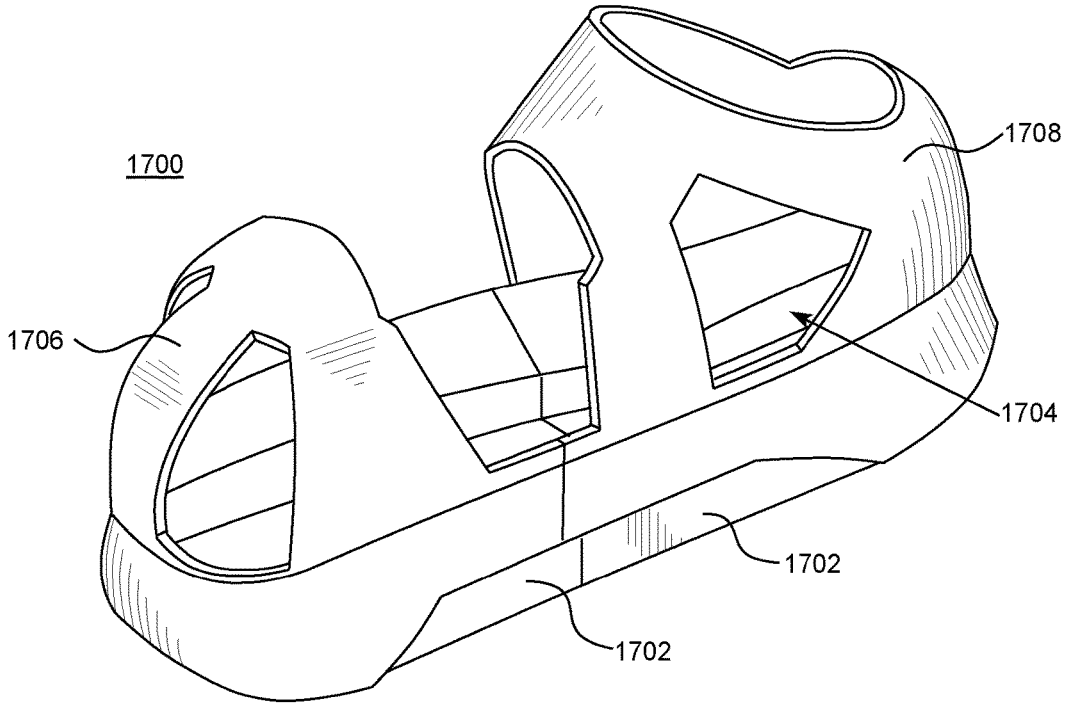
FIG. 18 is a perspective top view of the training ice skate of FIG. 17.

FIGS. 1-2 illustrate a first embodiment of a training ice skate. FIG. 3 illustrates a second embodiment of a training ice skate. FIGS. 4-7 illustrates a third embodiment of a training ice skate. FIG. 8 illustrates a means by which a side rail can attach to a side rail housing. FIG. 9 illustrates a fourth embodiment of a training ice skate. FIG. 10 illustrates a fifth embodiment of a training ice skate. FIG. 11 illustrates a sixth embodiment of a training ice skate. FIG. 12 illustrates a seventh embodiment of a training ice skate. FIG. 13 illustrates an eighth embodiment of a training ice skate. FIGS. 14-15 illustrate a ninth embodiment of a training ice skate. FIG. 16 illustrates a tenth embodiment of a training ice skate. FIGS. 17-18 illustrates an eleventh embodiment of a training ice skate.

Embodiments One Through Three

Figure 4A:
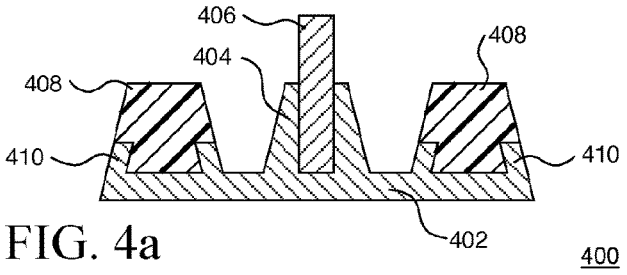
FIG. 4*a* is a front elevational, cross-sectional view of one embodiment of a boot mount of a training ice skate of the present disclosure.
Figure 4B:
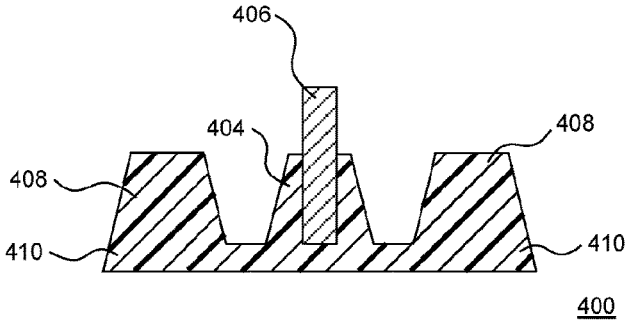
FIG. 4*b* is a front elevational, cross-sectional view of one embodiment of a boot mount of a training ice skate of the present disclosure.
Figure 4C:
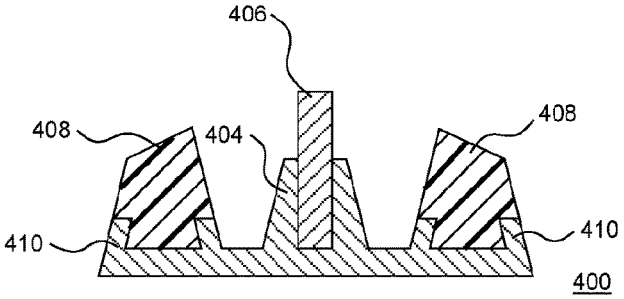
FIG. 4*c* is a front elevational, cross-sectional view of one embodiment of a boot mount of a training ice skate of the present disclosure.
Figure 4D:
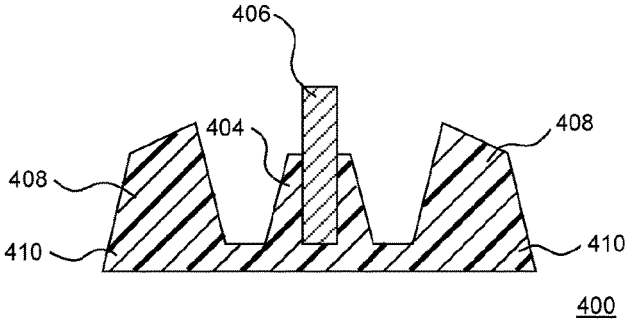
FIG. 4*d* is a front elevational, cross-sectional view of one embodiment of a boot mount of a training ice skate of the present disclosure.
Figure 5A:
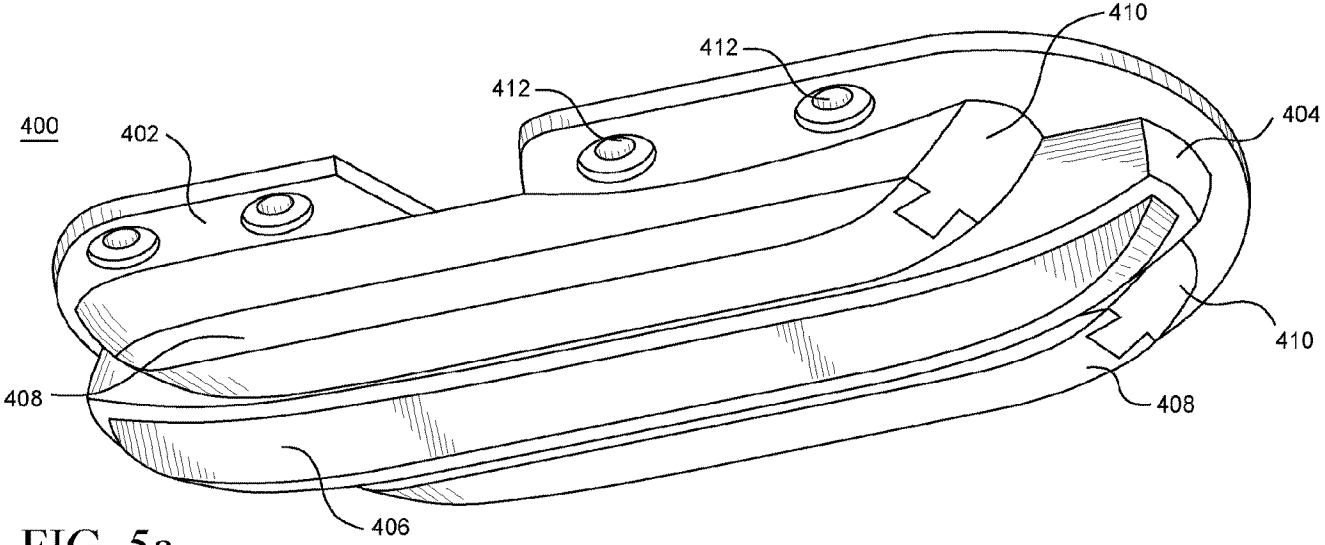
FIG. 5*a* is a perspective bottom view of a boot mount of a training ice skate of the present disclosure.
Figure 5B:
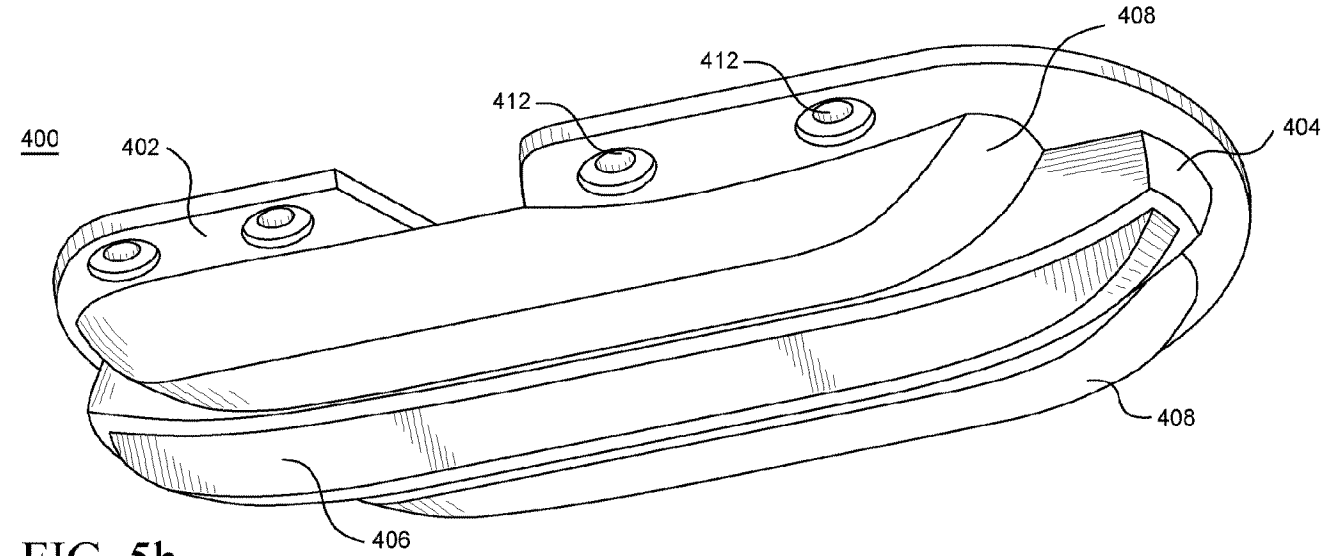
FIG. 5*b* is a perspective bottom view of a boot mount of a training ice skate of the present disclosure wherein the side rail and side rail housing are one continuous piece.
Figure 6:
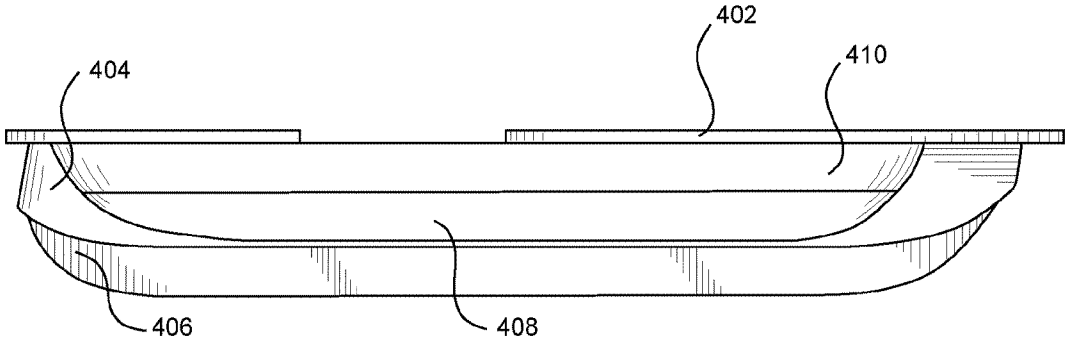
FIG. 6 is a right side elevational view of one embodiment of the boot mount of FIG. 5*a*.

In a first illustrative but non-limiting example, the disclosure provides a training ice skate that can include a boot, a boot mount, a center blade, and a plurality of side rails. FIG. 1 is a bottom perspective view of the boot mount 100 of a first embodiment of a training ice skate. FIGS. 2*a* and 2*b* are front elevational views of the boot mount 100 of the first embodiment of the training ice skate. FIGS. 3*a* and 3*b* are front elevational views of the boot mount 300 of a second embodiment of a training ice skate. FIGS. 4*a* to 4*d* are front elevational views of the boot mount 400 of a third embodiment of a training ice skate. FIG. 5*a* is a bottom perspective view of the boot mount 400 of the third embodiment of the training ice skate. FIG. 5*b* is a bottom perspective view of the boot mount 400 of the third embodiment of the training ice skate. FIG. 6 is a side elevational view of the boot mount 400 of the third embodiment of the training ice skate. FIG. 7 is a front elevational view of the boot mount 400 of the third embodiment of the training ice skate, illustrating various heights of side rails 408*a*, 408*b*, 408*c* that can be inserted into the side rail housings 410. FIG. 8 is a side view illustrating how side rail may fixedly attach to side rail housing.

The first, second, and third embodiments contain similar features and will be discussed as a group. Therefore, reference to the various components, unless specified, applies to all three variants. Therefore, reference to the boot mount includes boot mount 100, 300, and 400; reference to the base includes base 102, 302, and 402; reference to the blade housing includes blade housing 104, 304, and 404; reference to the center blade includes center blade 106, 306, and 406; references to the side rails includes side rails 108, 308, and 408; references to the rail housings includes rail housings 110, 310, and 410; and references to the attachments points includes attachment points 112 and 412. In some embodiments, two or more of these components are molded from one continuation piece. For example, the base, the blade housing, the side rail housings, and the side rails may all be molded from one continuous piece, as illustrated in FIGS. 4*b*, 4*d*, and 5*b*. In other embodiments, all of the pieces are separately molded or otherwise configured pieces, as illustrated in FIGS. 4*a*, 4*c*, and 5*a*.

In some embodiments, the boot mount can include: a base configured to attach to a bottom of boot 414, a blade housing centered on the base that is configured to house a center blade, and a plurality of side rails at non-center locations on the base.

The base can be made of any kind of rigid material such as, but not limited to, a polymer, metal, wooden, or other type or combination of materials. In some embodiments, the base can mount to the bottom of boot 414 using rivets, bolts, screws, adhesive material, or any other attachment mechanism or combination of attachment mechanisms at the attachment points, as illustrated in FIGS. 1 and 5. Alternatively, the base and/or a portion of the boot mount can be permanently affixed to the bottom of boot 414. For example, the base, instead of being an independent component, can be an extension of another component such as, but not limited to, the sides of boot 414. More specifically, the sides of boot 414 may extend downward from a top of the boot and may wrap under the boot to form the base.

In some embodiments, the base can have roughly the same shape and dimensions as the bottom face of boot 414. Further, if the boot mount is removable from boot 414 and has the same or similar dimensions and shape, the attachment points, in the case of rivets or bolts, may be in open positions on the base that are not covered by the blade housing, the center blade, the side rails, and/or the side rail housings. For example, the attachment points may be near and along the outer perimeter of the base, as illustrated in FIGS. 1 and 5.

More specifically, the base may have four quadrants with two or three attachment points in each quadrant. As illustrated in FIGS. 1 and 5, a quadrant is a corner of the base, and the four quadrants include a front right quadrant, a front left quadrant, a back right quadrant, and a back left quadrant. FIG. 1 illustrates three attachment points 112 in the front left quadrant and two attachment points 112 in the back left quadrant. FIG. 5 illustrates two attachments points 412 in each of the front and back right quadrants.

As illustrated in FIGS. 1-5 and 7, the blade housing can be located along a centerline of the boot mount running from front to back. The blade housing can be an extension of the base or can be separately attached to the base. In some embodiments, as illustrated in FIGS. 1-5 and 7, the blade housing can have two walls, such as, but not limited to, sidewalls, that at least partially encompass the center blade and offer support and attachment point(s) for the center blade. The center blade can be metal or any other rigid material and can have a low height/profile compared to an industry standard height/profile. For example, the two walls of the blade housing may cover a portion of the height and length of the center blade. Alternatively, the two walls of the blade housing may cover a portion of the height and the entire length of the center blade. Further, the blade housing can fully encompass the center blade by having front and back walls that connect to the two sidewalls of the blade housing. In another example, the two walls may wrap around the two ends of the center blade to hold it in place.

In some embodiments, the plurality of side rails 108, 308 may be fixed in place and not removable or replaceable, as illustrated in FIGS. 1-3. For example, side rails 108 may be held in place by side rail housings 110 similar to how blade housing can hold center blade in place, as described above. More specifically, side rail housings 110 can be an extension of base 102 (for example, side rail housings 110 can be contoured out of the base material and, therefore, made of the same material as base 102) or can be separately attached to the base. In another example, side rails 108 can be attached to side rail housings 110 by use of glue or mechanical fasteners. In one case of mechanical fasteners, a countersunk head threaded bolt or screw can attach side rails 108 to side rail housings 110. The countersunk head, in some cases, can be structured and configured not to penetrate out past the gliding surface of the side rail 108. This can help to prevent the head of the fastener from making contact with the ice, which could potentially cause the ice skater to stumble.

In some embodiments, as illustrated in FIGS. 1 and 2*a*-2*b*, side rail housings 110 can each have two walls, such as, but not limited to, sidewalls, that at least partially encompass the plurality of side rails 108 and offer support and an attachment point for the plurality of side rails. For example, the two walls of side rail housings 110 may cover a portion of the height and length of side rails 108. Alternatively, the two walls of side rail housings 110 may cover a portion of the height and the entire length of side rails 108. Further, side rail housings 110 can fully encompass side rails 108 by having front and back walls that connect to the two sidewalls of the side rail housings. In another example, the two walls may wrap around the two ends of side rails 108 to hold them in place.

In some embodiments, as illustrated in FIGS. 3*a*-3*b*, side rails 308 may be fixed in place based on their configuration or other attachment mechanism to side rail housing 310. More specifically, side rails 308 may be configured to have flat stopper 308*a*, shaft 308*b*, and cap 308*c*, and each side rail housing 310 may be defined by base 102, inner support wall 310*a* and outer support wall 310*b*, wherein the inner and outer support walls connect base to the bottom of the boot. Flat stopper 308*a* can prevent side rail 308 from separating from base 102 in a first direction, shaft 308*b* can pass through an aperture in base 102, and cap 308*c* can protrude out from the outward-facing side of the base 102 to offer support to the skater and prevent side rail 308 from separating from base 102 in a second direction, as illustrated in FIGS. 3*a*-3*b*.

More specifically, stopper 308*a* can be disc-shaped or any other shape as long as it has a diameter, width and/or length that is wider than an opening/aperture in base 102, which allows it to remain within side rail housing 310 on a boot-facing side of the housing and prevents it from squeezing or sliding through the opening/aperture in the base that shaft 308*b* can fit through. Therefore, stopper 308*a* prevents side rail 308 from separating from base 102 in the first direction. Shaft 308*b* can be any elongated shape that, on one end, connects to stopper 308*a* and, on a second end, connects to cap 308*c*. Cap 308*c* can be located on a ground-facing side of the base, can be raised and can have a flat or slightly rounded outer layer that is structured and configured to offer support to a skater when the skater wobbles on the ice skate. More specifically, cap 308*c* can be tall enough (i.e., have a high enough profile) that, when a skater's ankles roll in or out and the skate rotates, the cap prevents the skate from rotating further in that direction. This height can be between half the height of center blade 306 and the total height of center blade 306. Further, cap 308*c* can also have a larger diameter, width, and/or length than the opening/aperture, which can prevent each side rail 308 from separating from base 102 in a second direction.

In other embodiments, side rails 408 can be removable, as illustrated in FIGS. 4-5 and 7, can have a shorter profile compared to center blade 406, as illustrated in FIG. 6, can be toleranced such that they can be removably attached to side rail housings 410, and can be constructed at least partially of a semi-flexible material such as, but not limited to, an elastomeric or any other plastic compound. Further, side rails 408 can be configured to attach via friction fit to side rail housings 410 by sliding into the side rail housings. For example, the connection between side rails 408 and side rail housings 410 can include a dovetail joint or a t-slot joint, and a rear end of each of the side rail housings can have a stop to prevent the side rails from sliding out a back end of the side rail housings. In some embodiments, side rails 408 can alternatively, or in addition to a friction fit, be secured by a bolt, detent, rivet, or other mechanical fastener (for example, a bolt or screw that is compatible with an Allen wrench) for added security and to prevent accidental slippage of the side rails. More specifically, as described above, side rails 408 can be fixedly attached to side rail housings 410 by use of a countersunk head threaded bolt or screw 416, as illustrated in FIG. 8. While these embodiments illustrate side rails 408 as removable from side rail housings 410, the side rails can also be fixed in place or can be an extension of the side rail housings.

Additionally, in some embodiments, there may be several variations of side rails 408 having different heights, as illustrated in FIG. 7, or contours or the side rails may be removably stackable on top of one another to increase and decrease height. Side rails 408 of differing heights may be distinguishable by color and may have variable durometers. A higher durability could be associated with a more novice-based side rail 408. In this embodiment, side rails 408 may be interchangeable, so a user can adjust the support offered by the training ice skate as they improve in skill. Further, regardless of the heights of side rails 408, they can provide a user with proper form while the user is learning to skate, thus providing ergonomic learning. More specifically, the side rails can be chamfered or contoured to support a skater's foot as they push off. As illustrated in FIGS. 2*b*, 3*b*, and 4*c*-4*d*, the side rails can have a contoured or beveled surface on their ground-facing side, wherein the contoured or beveled surface is at a non-parallel angle to the base (for example, between 30 and 60 degrees) such that the side rails can make increased contact with the ice plane if and when a user's ankle, and therefore ice skate, rotates to move a left or right side of the skate closer to the ice. For example, when a skater positions his or her foot inward to push off, the angled, beveled surface of the side rails can be angled to ensure a skater's foot moves to, but no further than, the proper position so that the skater learns where and how his or her foot should be positioned during that movement. This assists a user with learning proper skating form while learning how to skate on ice.

Additionally, the option to interchange side rails 408 enables a beginner ice skater to insert a first side rail, such as a tall side rail 408*a*, by pushing it from the front of side rail housing 410 to the back of the side rail housing until the first side rail rests against the stop (not shown). Once the ice skater has improved in skill, he or she can replace the first side rail 408*a* with a second side rail, such as, but not limited to, a medium-height side rail 408*b* or a short side rail 408*c*. More specifically, the ice skater can slide the first side rail 408*a* forward and out of side rail housing 410 and then push the second side rail 408*b* from the front of the side rail housing to the back until the second side rail rests against the stop. Similarly, when the ice skater decides the second side rail 408*b* offers more support than he or she needs, the ice skater can remove the second side rail 408*b* and replace it with a shorter, third side rail 408*c*.

The side rails can be located on either side of the blade housing and, in some embodiments, there is one side rail on each side of the blade housing, as illustrated in FIGS. 1, 3, and 4. The side rails can each be elongated, blade-like components that run the length, or at least a portion of the length, of the base from front to back. These side rails can be narrow on their end to more closely resemble a blade, as illustrated in FIGS. 1-2, or they can be flattened to offer more stable support, as illustrated in FIGS. 3-5 and 7. In some embodiments, there are two side rails and each one is one continuous piece. In other embodiments, there are two side rail groupings that make up each side rail. For example, one side rail may be comprised of a plurality of shorter, blade-like components positioned in line with each other.

Embodiments Four Through Eleven

In a second illustrative but non-limiting example, the disclosure provides a training ice skate that can include a boot, a boot mount, a blade, and a plurality of support mounts. FIG. 9 is a bottom perspective view of the boot mount 900 of a fourth embodiment of a training ice skate. FIG. 10 is a bottom perspective view of the boot mount 1000 of a fifth embodiment of the training ice skate. FIG. 11 is a bottom perspective view of the boot mount 1100 of a sixth embodiment of a training ice skate. FIG. 12 is a bottom perspective view of the boot mount 1200 of a seventh embodiment of a training ice skate. FIG. 13 is a bottom perspective view of the boot mount 1300 of an eighth embodiment of the training ice skate. FIG. 14 is a bottom perspective view of the boot mount 1400 of a ninth embodiment of the training ice skate. FIG. 15 is a side elevational view of the boot mount 1400 of the ninth embodiment of the training ice skate. FIG. 16 is a bottom perspective view of the boot mount 1600 of a tenth embodiment of the training ice skate. FIG. 17 is a top perspective view of the boot mount 1700 of an eleventh embodiment of the training ice skate, illustrating two main components in their separated configurations. FIG. 18 is a top perspective view of the boot mount 1700 of the eleventh embodiment of the training ice skate.

As with above, the fourth through eleventh embodiments contain similar features. Therefore, reference to the various components, unless specified, applies to all eight variants. Therefore, reference to the boot mount includes boot mount 900, 1000, 1100, 1200, 1300, 1400, 1600, and 1700; reference to the base includes base 902, 1002, 1102, 1202, 1302, 1402, 1602, and 1702; reference to the blade housing includes blade housing 904, 1004, 1104, 1204, 1304, 1404, 1604, and 1704; reference to the center blade includes center blade 906, 1006, 1106, 1206, 1306, 1406, 1606, and 1706; and references to the boot include boot 910, 1012, 1110, 1216, 1416, and 1614.

Similar to the embodiments described above, the training ice skate illustrated in FIGS. 9-18 can have a boot and a boot mount, wherein the boot mount can include a base configured to attach to a bottom of the boot and a blade housing centered on the base that is configured to house a center blade. Additionally, various support mounts can be attached to the bottom of the base.

FIGS. 9, 10, and 11 illustrate embodiments of the second illustrating but non-limiting example, wherein, in addition to boot mount 902, 1002, 1102, blade housing 904, 1004, 1104, and center blade 906, 1006, 1106, the training ice skate includes foam side supports 908, 1008, 1108. Foam side supports 908, 1008, 1108 can be foam blocks positioned on the side surfaces of blade housing 904, 1004, 1104 and center blade 906, 1006, 1106.

In some embodiments, foam side supports 908, 1008, 1108 can be at least two separate pieces and can be held in place on the training ice skate by attaching to each other through a gap in metal center blade 906, 1006, 1106. For example, foam side supports 908, 1008, 1108 can have bridge pieces that pass through the gap between the front and back portions of blade housing 904, 1004, 1104 and attach to each other. This attachment can take place via a nesting, friction fit (i.e., a bridge piece of first foam support 908, 1008, 1108 can have a friction fit with a bridge piece of second foam support 908, 1008, 1108) or by bolting to each other, as illustrated in FIG. 10. More specifically, if foam supports 1008 are bolted to each other, they can each have thin inner wall 1010 near the centerline of boot 1012 and within the gap that is between the front and back portions of blade housing 1004. Therefore, during installation, thin inner walls 1010 of foam supports 1008 are near each other and capable of being bolted together. In some embodiments, thin inner walls 1010 can be a thinner continuation of the same material as foam supports 908, 1008, 1108. In other embodiments, they can be a separate part configured of a different material that is attached directly to foam supports 908, 1008, 1108.

Figure 11A:
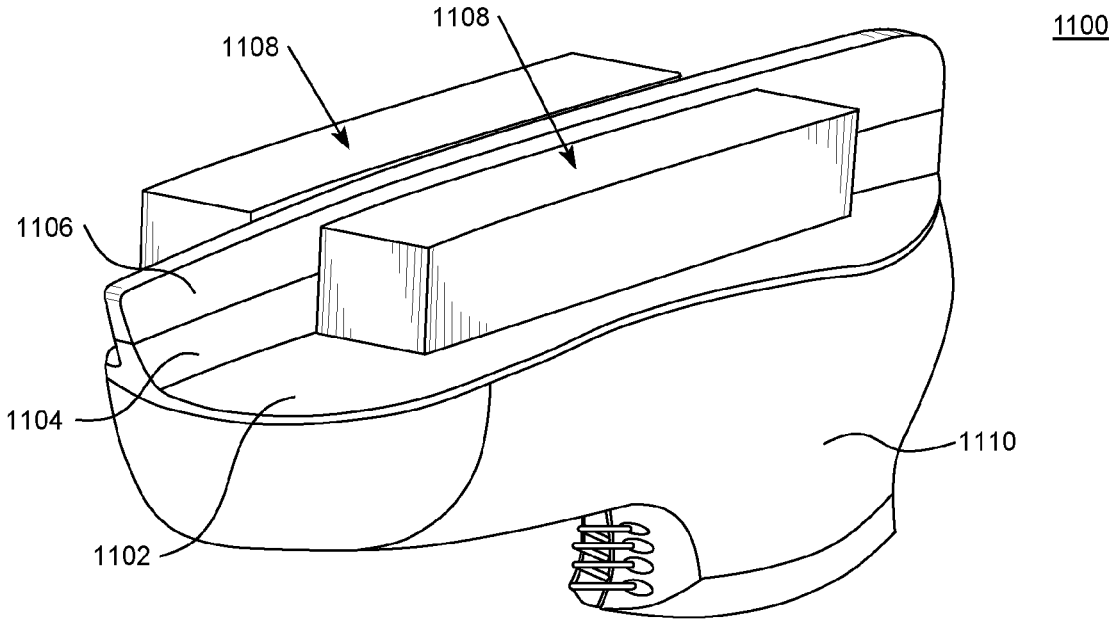
FIG. 11*a* is a perspective bottom view of a training ice skate of the present disclosure.
Figure 11B:
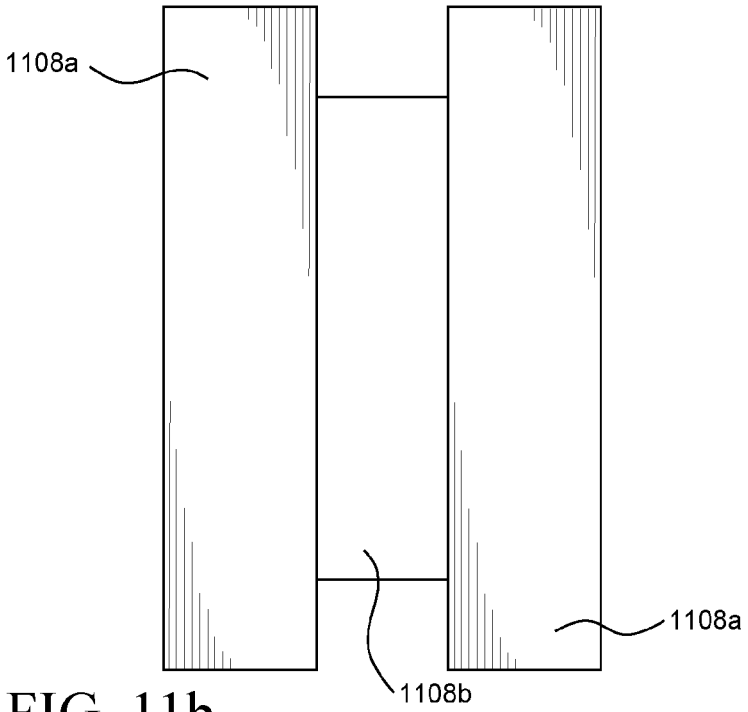
FIG. 11*b* illustrates foam side supports that are one continuous piece.

In some embodiments, foam side supports 1108 are one continuous piece having two pontoons 1108*a* and one bridge 1108*b* connecting the two pontoons to each other, as illustrated in FIGS. 11*a* and 11*b*. Pontoons 1108*a* can be rectangular pieces that run along the outer edges of blade housing 1104 and center blade 1106 so that they are longer than they are wide. To install on a training ice skate, a first pontoon 1108*a* can be pushed through the gap in between the front and back portions of blade housing 1104 until first pontoon 1108*a* is positioned on the opposite side of center blade 1106 from a second pontoon 1108*a*. Once it has been pushed all the way through, first and second pontoons 1108*a* can be parallel to each other and bridge 1108*b* can be perpendicular, and between, both pontoons.

In some embodiments, foam side supports 908 can be porous foam blocks that cover a majority of blade housing 904 and center blade 906, as illustrated in FIG. 9. However, foam side supports 908 can also be limited in size so that they are located only in the front or back of the training ice skate. Foam side supports 908 can cover a majority of blade housing 904 and center blade 906, and the tops of foam side supports 908 can be uniformly flat or they can follow the form of boot 910. For example, they may have a back portion that is flat, a middle portion angled downward that follows the angle of boot 910, and a front portion that is flat, as illustrated in FIG. 9. Further, the bottom, sides, fronts and/or backs of foam side supports 908 can be uniformly flat. To stay in place, foam side supports 908 can, as described above, attach through the gap in between the front and back portions of blade housing 904. Alternatively, an attachment mechanism may wrap around the outside of foam side supports 908 to hold them in place.

FIGS. 12 and 13 illustrate additional embodiments of the second illustrating but non-limiting example, wherein, in addition to boot mount 1202, 1302, blade housing 1204, 1304, and center blade 1206, 1306, the training ice skate includes a plurality of support mounts 1208, 1308 that are rigid and include a plastic, glass-filed nylon (i.e., fiberglass), or other rigid material or combination of rigid materials. Support mounts 1208, 1308 can be configured to mount to blade housing 1204, 1304 and/or to metal center blade 1206, 1306 (for example, to a side of the center blade 1206, 1306), can be rigid, and can be comprised of width component 1212, 1312 that protrudes out in a perpendicular plane to center blade 1206, 1306.

In addition to width component 1212, each support mount 1208 can include, in some embodiments, blade mount 1210 and side rail 1214, as illustrated in FIG. 12. Blade mount 1210, width component 1212, and side rail 1214 can be long, narrow pieces having first and second ends. Further, blade mount 1210 can be an elongated mount having a first, front end and a second, back end. The first, front end can be on the front half of center blade 1206 with the second, back end on the back half of the center blade, Alternatively, the first, front end as well as the second, back end can be located on the back half of center blade 1206. As stated above, width component 1212 can protrude out in a perpendicular plane to center blade 1206 and can have a first, inner end and a second, outer end, wherein the first, inner end is nearer to center blade 1206 than the second, outer end. Side rail 1214 can, similar to blade mount 1210, be an elongated side rail 1214 having a first, front end and a second, back end.

Blade mount 1210 can run parallel to center blade 1206 and can attach on its second, back end to the first, inner end of width component 1212. Side rail 1214 can also run parallel to center blade 1206 and can attach on the second, back end to a second, outer end of width component 1212. In some embodiments, blade mount 1210 and side mount 1214 are the same length. In other embodiments, blade mount 1210 and side mount 1214 are different lengths. For example, side mount 1214 may be longer than blade mount 1210 or the blade mount may be longer than the side mount.

In some embodiments, as illustrated in FIG. 13, each of support mounts 1308 can be comprised of blade mount 1310, block width component 1312, and side rail 1314. More specifically, blade mount 1310 can include a flat inner face of support mount 1308 that rests against blade 1306 and a screw or screw-like component that connects the blade mount to the blade. In some embodiments, blade mount 1310, block width component 1312, and side rail 1314 can be molded from one piece. Alternatively, one or more of components 1310, 1312, 1314 can be separate pieces that are attached to each other using rivets, bolts, screws, or adhesives.

Each width component 1312 can be a solid or hollow block having a flat, quadrilateral, bottom-facing surface and a sloped, upper-facing surface, as illustrated in FIG. 13. The sloped, upper-facing surface can slope downward from an inner area of width component 1312 to an outer area of the width component. Support mounts 1308 can be configured to attach to the training ice skate in a reversed position (i.e., upside down) so the flat, quadrilateral surface is an upper-facing surface and the sloped surface is a bottom-facing surface. Width components 1312 can, instead of being rigid, be somewhat softer and more flexible. For example, width components 1312 may include a high durometer elastomer, ABS, or other semi-rigid material or combination of materials that allows it to have some flexibility.

Side rail 1314 can be roughly rectangular, can be located along an outer edge of width component 1312, as illustrated in FIG. 13, and, when the skate is worn, can project downward toward the ground from the outer edge of the width component. In some embodiments, side rail 1314, in addition to projecting downward, can project upward from the outer portion of width component 1314. This can assist in situations where support mounts 1308 are flipped upside down.

In some embodiments, as illustrated in FIGS. 14-16, support mounts 1408, 1608 can mount to base 1402, 1602 instead of attaching to blade housing 1404, 1604 and/or center blade 1406, 1606. Further, support mounts 1408, 1608 can be rigid and can be located at four corners of base 1402, 1602. Support mounts 1408, 1608 can be molded from one piece, or one or more of the components of the support mounts can be separate pieces that, combined, form the support mounts.

In some examples, each support mount 1408 can be, rigid, quadrilateral, and can have a center aperture, as illustrated in FIG. 14. More specifically, each support mount 1408 can have top component 1410 that mounts to base 1402, two elongating components 1412, and bottom component 1414 structured and configured to make contact with ice when the training ice skate is used.

Top component 1410 can mount to base 1402 using bolts or rivets and can be located at one of four quadrants of boot 1400 and base 1402. More specifically, as described above, boot 1400 and base 1402 may have four quadrants, wherein the four quadrants include a front right quadrant, a front left quadrant, a back right quadrant, and a back left quadrant. Therefore, each of four support mounts 1408 may be located in a quadrant providing even distribution of support for the training ice skate.

A first of two elongating components 1412 can be attached on a top end to a first, front end of top component 1410 and can be attached on a bottom end to a first, front end of bottom component 1414. A second of two elongating components 1412 can be attached on a top end to a second, back end of top component 1410 and can be attached on a bottom end to a second, back end of bottom component 1414.

Bottom component 1414 can be a blade-like component that is designed to offer support to a skater when the skater wobbles on the training ice skate. More specifically, elongating components 1412 can be long enough so that when a skater's ankles roll in or out and the skate rotates, the elongating components prevent the skate from rotating even further in that direction. This length can be between half the height of center blade 1406 and the total height of the center blade.

In some embodiments, instead of a plurality of support mounts having center apertures, support mounts 1608 can include rigid posts 1612. More specifically, each support mount 1608 can have top component 1610, which mounts to base 1602, and elongated support post 1612.

Similar to the above-described quadrilateral support mounts 1408, top component 1610 of the post support mounts 1608 can mount to base 1602 using bolts or rivets and can be located at one of four quadrants of the boot 1600 and base 1602. Boot 1600 and base 1602 may also have four quadrants, as described above.

Each of rigid posts 1612 can be attached on a top end to top component 1610 and can have an unattached end. Posts 1612 can be hollow or solid and can offer support to a skater when the skater wobbles on the training ice skate. More specifically, posts 1612 can be long enough so that when a skater's ankles roll in or out and the skate rotates, at least one of the posts can prevent the skate from rotating even further in that direction. This length can be between half the height of center blade 1606 and the total height of center blade 1606.

In some embodiments, posts 1612 are designed so that they can be trimmed as the ice skater improves in skill. In other embodiments, posts 1612 are comprised of a plurality of height components that stack together to provide height. A new ice skater could use several height components to make posts 1612 longer and an ice skater that has improved in skill and does not require as much support could remove one or more of the height components to make the posts shorter.

In some embodiments of the second illustrative but non-limiting example, and as illustrated in FIGS. 17-18, the training ice skate can include base 1702, front boot cage 1706, rear boot cage 1708, and locking mechanism 1710 for attaching the front and the rear boot cages to each other. Base 1702 can be relatively flat on its top surface and can have center aperture 1704 through which a portion of the center blade (not numbered) can protrude. Front and rear boot cages 1706, 1708 can, together, surround at least a portion of the boot (not numbered) and a portion of the center blade.

Locking mechanism 1710, in some examples, can include two side straps 1710*a*, 1710*b* that are each attached on their first ends to opposite sides of front boot cage 1706. Further, each side strap 1710*a*, 1710*b* can have an attachment point on its second end that enables the two side straps to attach to each other. Each side strap 1710*a*, 1710*b* can wrap around to a back of rear boot cage 1708. Therefore, locking mechanism 1710 can allow for variation in shoe sizes. Alternatively, side straps 1710*a*, 1710*b* can slide through a middle portion of rear boot cage 1708 and attach to each other in a position on top of a shoe.

Front boot cage 1706 and rear boot cage 1708 can each be comprised of adjustment control 1712, 1714, respectively, and at least one cutout 1716. More specifically, adjustment controls 1712, 1714 can be ratchets or hook and loop fasteners that enable an ice skater to adjust how well a shoe fits into of the training ice skate.

In some embodiments, base 1702 includes EVA foam and front boot cage 1706 and rear boot cage 1708 include fabric, plastic, or any other material or combination of materials that enables a user to fit the front and rear boot cages over the boot (not numbered) or a shoe. Locking mechanism 1710 can include a hook and loop fastener, buckles, snaps, buttons, or a combination of these.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A training ice skate boot mount, comprising:
a base;
a blade housing centered on the base and configured to house a metal center blade; and
a plurality of side rail housings at non-center locations on the base configured to house a plurality of side rails, wherein
each of the plurality of side rail housings has a ground-facing side, and
the ground-facing sides of the plurality of side rails are beveled at a non-parallel angle to the base such that the ground-facing sides are facing away from the blade.

2. The training ice skate boot mount of claim 1, wherein the plurality of side rails are removable.

3. The training ice skate boot mount of claim 2, wherein the plurality of side rails removably attach to the plurality of side rail housings using a friction fit.

4. The training ice skate boot mount of claim 2, wherein the plurality of side rails further attach to the plurality of side rail housings using means selected from the group consisting of countersunk screws, bolts, and combinations thereof.

5. The training ice skate boot mount of claim 2, wherein:
at least one of a front or a rear end of each of the plurality of side rail housings has a stop;
the plurality of side rails are configured to removably attach by sliding into the plurality of side rail housings along a connection point; and
the connection point between the plurality of side rails and the plurality of side rail housings is a dovetail joint.

6. The training ice skate boot mount of claim 2, wherein:
at least one of a front or a rear end of each of the plurality of side rail housings has a stop;
the plurality of side rails are configured to removably attach by sliding into the plurality of side rail housings along a connection point; and
the connection point between the plurality of side rails and the plurality of side rail housings is a t-slot joint.

7. The training ice skate boot mount of claim 2, wherein:
the plurality of side rails are comprised of at least two interchangeable sets of side rails;
each set of interchangeable side rails has a different height than each other set; and
the side rail housings are configured to fit only one set of side rails at a time.

8. The training ice skate boot mount of claim 1, wherein each of the plurality of side rails are comprised of:
a flat stopper on a boot-facing side of the side rail;
a shaft; and
a cap on the ground-facing side of the side rail.

9. The training ice skate boot mount of claim 8, wherein:
the flat stopper has a larger diameter, width, or length than an aperture in the base and prevents each side rail from separating from the base in a first direction;
the shaft passes through the aperture; and
the cap protrudes out from a ground-facing side of the base and has a larger diameter, width, or length than the aperture and prevents each side rail from separating from the base in a second direction.

10. The training ice skate boot mount of claim 1, wherein the plurality of side rails:
are fixed in place using fastening means selected from the group consisting of screws, bolts, rivets, adhesives, and combinations thereof; and
have a shorter profile than the center blade.

11. The training ice skate boot mount of claim 1, wherein the base is a continuation of sides of a boot that extend downward from a top of the boot and wrap under the boot.

12. The training ice skate boot mount of claim 11, wherein the plurality of side rails are removable.

13. The training ice skate boot mount of claim 12, wherein the plurality of side rails removably attach to the plurality of side rail housings using a friction fit.

14. The training ice skate boot mount of claim 12, wherein:
the plurality of side rails are configured to removably attach by sliding into the plurality of side rail housings along a connection point;
the connection point between the plurality of side rails and the plurality of side rail housings is a dovetail or t-slot joint; and
at least one of a front or a rear end of each of the plurality of side rail housings has a stop.

15. The training ice skate boot mount of claim 12, wherein:
the plurality of side rails are comprised of at least two interchangeable sets of side rails;
each set of interchangeable side rails has a different height than each other set; and
the side rail housings are configured to fit only one set of side rails at a time.

16. The training ice skate boot mount of claim 1, wherein the base, the blade housing, the plurality of side rail housings, and the plurality of side rails are one continuous piece.

17. A training ice skate boot mount, comprising:
a base;
a blade housing centered on the base and configured to house a metal center blade; and
a pair of side rail housings at non-center locations on the base configured to house one or more sets of removable and interchangeable side rails;
wherein:
a first side rail housing is located on a first side of the blade housing;
a second side rail housing is located on a second side of the blade housing;
and
a first set of removable and interchangeable side rails have a different height than a second set of removable and interchangeable side rails.

18. The training ice skate boot mount of claim 17, wherein each of the plurality of side rail housings has a ground-facing side, and the ground-facing sides of the plurality of side rails are beveled at a non-parallel angle to the base.

19. The training ice skate boot mount of claim 17, wherein
the training ice skate has a base on the bottom that is a continuation of sides of a boot that extend downward from a top of the boot and wrap under the boot, and
the first and second side rail housings are located on the base.

20. A method of adjusting support offered by a training ice skate, the method comprising:
sliding a first side rail having a first height into or out from a first side rail housing that is located on a first side of a center blade on a bottom of the training ice skate; and
sliding a second side rail having the first height into or out from a second side rail housing that is located on a second side of the center blade on the bottom of the training ice skate.

* * * * *